United States Patent [19]

Caley et al.

[11] 4,180,195

[45] Dec. 25, 1979

[54] RIVET DELIVERY AND LOCATING APPARATUS

[75] Inventors: Kenneth E. Caley, Seattle; Brian R. Trethewy, Snohomish, both of Wash.

[73] Assignee: The Boeing Company, Seattle, Wash.

[21] Appl. No.: 869,966

[22] Filed: Jan. 16, 1978

[51] Int. Cl.[2] ..... B27F 7/04

[52] U.S. Cl. ..... 227/51; 227/69; 227/111; 227/119; 227/149

[58] Field of Search ..... 227/69, 109, 111, 139, 227/148, 149, 51, 119; 72/391, 424

[56] References Cited

U.S. PATENT DOCUMENTS

| | | | |
|---|---|---|---|
| 434,215 | 8/1890 | Unbehend | 227/139 |
| 2,101,924 | 12/1937 | Turnquist | 227/62 |
| 2,620,876 | 12/1952 | Harness et al. | 72/23 |
| 2,896,208 | 7/1959 | Alderman et al. | 227/139 |
| 3,030,832 | 4/1962 | Filangeri | 227/5 |
| 3,049,713 | 8/1962 | Dupuy et al. | 227/112 |
| 3,081,885 | 3/1963 | Carlzen et al. | 227/139 |

*Primary Examiner*—John McQuade
*Attorney, Agent, or Firm*—Lynn H. Hess; B. A. Donahue

[57] ABSTRACT

A delivery and locating apparatus for receiving an orientated rivet dispensed from a supply of rivets and positioning the rivet for a heading operation. The apparatus includes a gripping mechanism movable between a rivet receiving position and a rivet locating position and includes gripping surfaces which are biased together by a spring member for gripping the shank portion of a rivet provided from a delivery tube. The delivery tube includes a cam portion which separates the gripping surfaces against the bias from the spring member when the gripping mechanism moves into a rivet receiving position so that the shank portion of the rivet from the delivery tube can move freely between the gripping surfaces. As the gripping mechanism moves away from the delivery tube the gripping surfaces are forced together by the bias from the spring, and the gripping surfaces hold the shank portion of the rivet firmly as the gripping mechanism moves from its rivet receiving to its rivet locating position.

21 Claims, 18 Drawing Figures

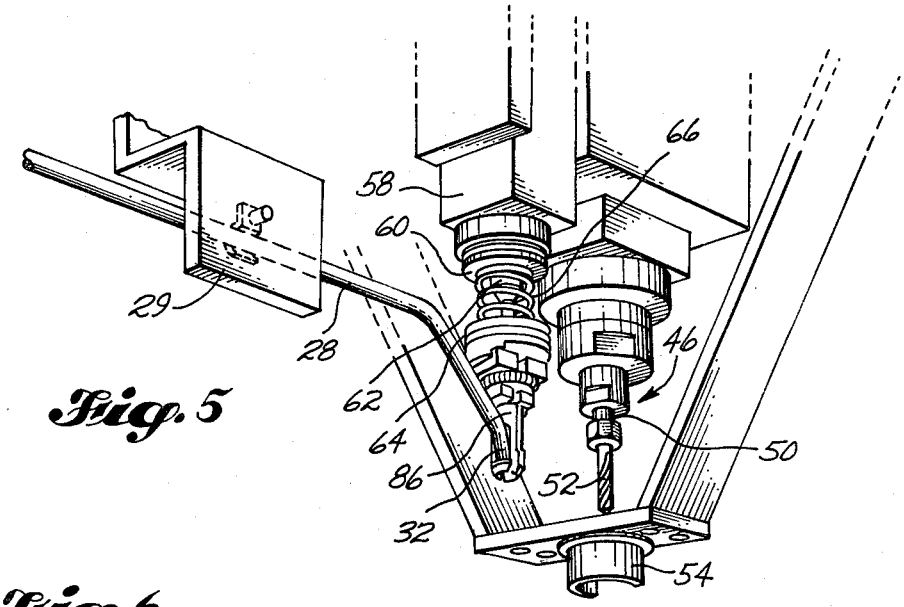
Fig. 5
Fig. 6
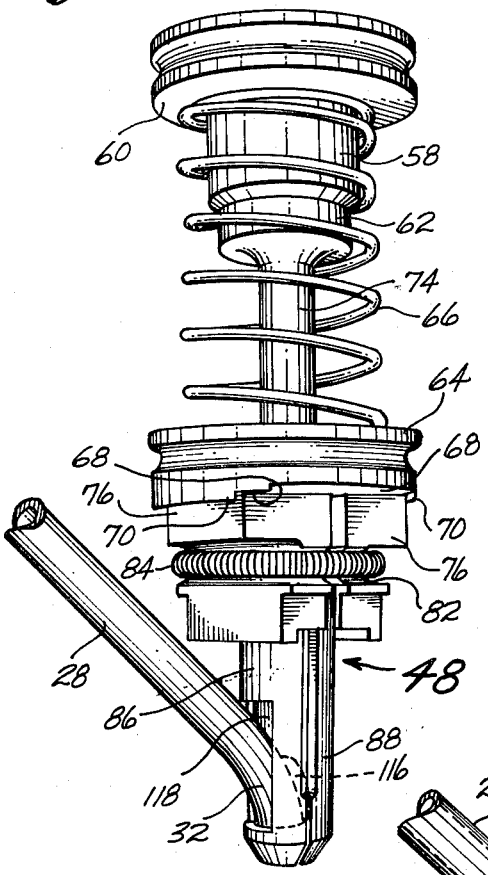
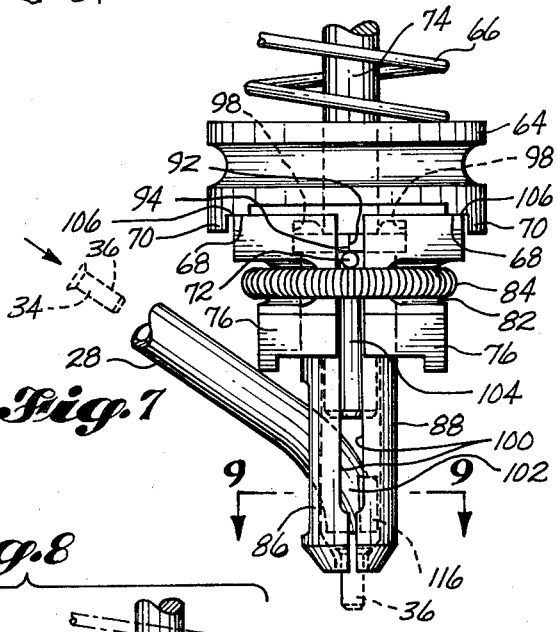
Fig. 7
Fig. 8
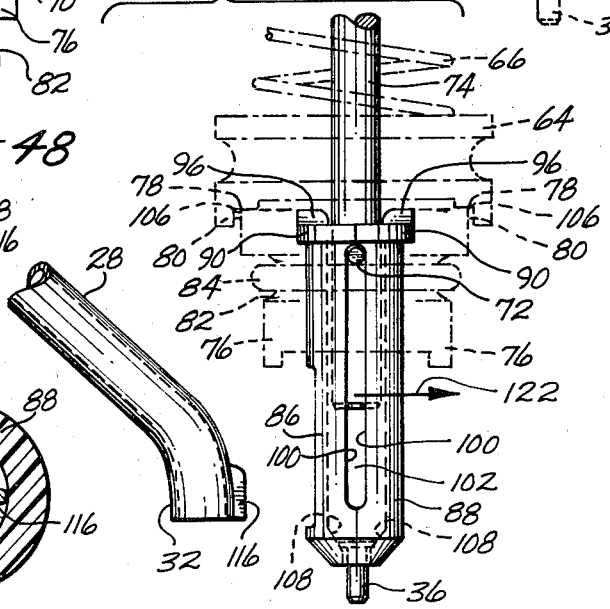
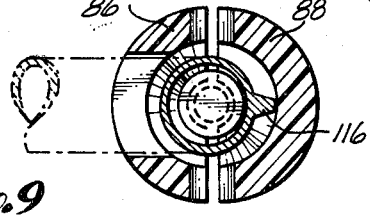
Fig. 9

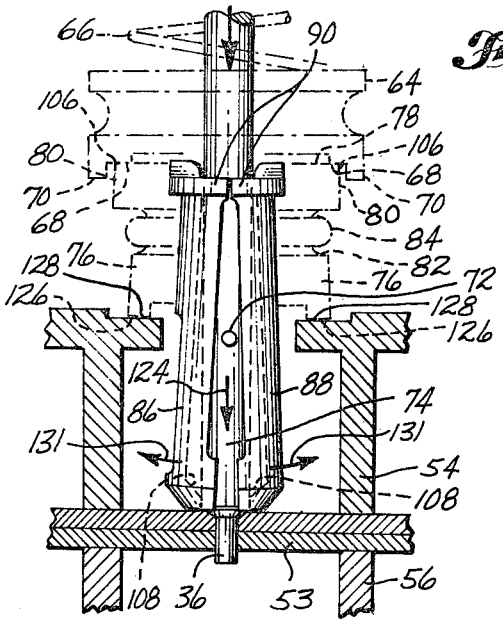
Fig. 10
Fig. 11
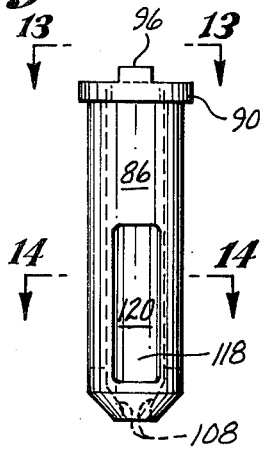
Fig. 12
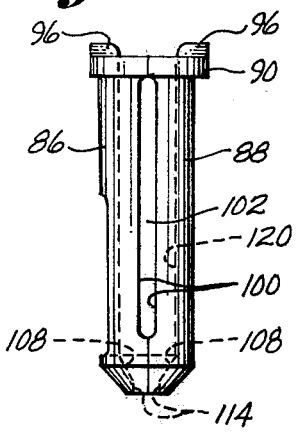
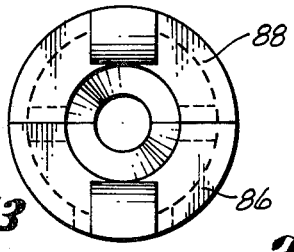
Fig. 13
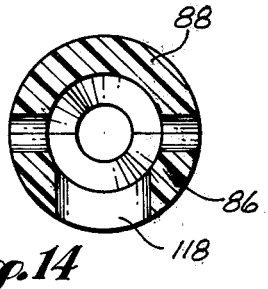
Fig. 14
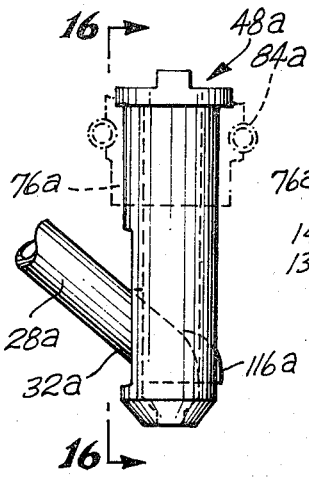
Fig. 15
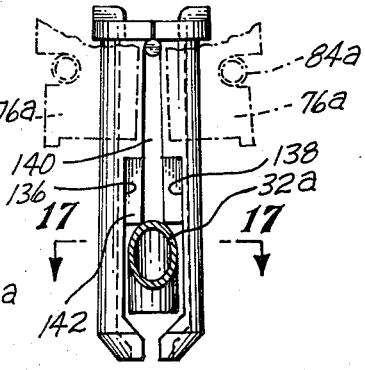
Fig. 16
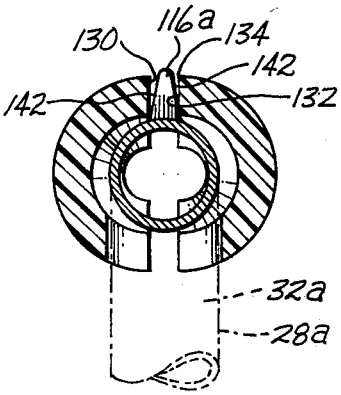
Fig. 17
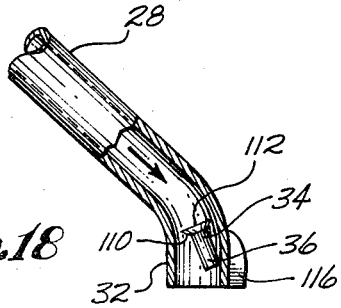
Fig. 18

RIVET DELIVERY AND LOCATING APPARATUS

BACKGROUND OF THE INVENTION

This invention relates to an apparatus for receiving an individual rivet dispensed from a supply of rivets and positioning the rivet for a heading operation.

Automatic riveting machines are commonly used in manufacturing for fastening workpieces together. A supply of rivets is provided to the riveting machine which, in response to the manipulation of machine controls by an operator, drills a hole through the workpieces, locates an individual rivet with respect to the hole, and performs a heading operation on the rivet. Such riveting machines require apparatus for receiving an individual rivet from the supply and accurately positioning the rivet with respect to the hole drilled for it through the workpieces.

One such automatic riveting machine is disclosed in U.S. Pat. No. 3,030,832 to A. E. Filangeri et al. The riveting machine according to the disclosure of the Filangeri et al patent automatically senses the aggregate thickness of the materials to be joined together and, while a drilling operation is taking place, feeds a rivet of appropriate length to a spring gripper which is subsequently aligned with the hole being drilled.

In modern high-speed riveting machines, especially those which utilize rivets of different sizes during consecutive riveting operations, it is important that the apparatus which receives each individual rivet from the supply and positions it with respect to the hole in the workpieces be capable of rapid and uninterrupted operation; and it is also essential that each rivet delivered from the supply be gripped in precisely the correct orientation, with this correct orientation being maintained for locating the rivet with respect to its hole in the workpieces.

SUMMARY OF THE INVENTION

According to the invention improved means are provided in a riveting apparatus for delivering and locating individual rivets for a heading operation. The improved means according to the invention comprises a delivery tube through which individual rivets are delivered in an orientated manner from a supply of rivets, gripping means for receiving individual rivets from the delivery tube and including gripping surfaces operable between a rivet-receiving mode and a rivet gripping mode, means for operating the gripping means to the rivet receiving and rivet gripping modes respectively, and means for moving the gripping means between a rivet receiving position adjacent the delivery tube and a position locating the rivet with respect to a hole in the workpiece for a heading operation.

DESCRIPTION OF THE DRAWINGS

FIG. 5 is a pictorial view of a portion of the riveting machine including structure according to the invention;

FIG. 6 is an enlarged pictorial view of a delivery tube and gripping apparatus according to the invention;

FIG. 7 is a side elevation view of a delivery tube and gripping apparatus according to the invention showing the gripping apparatus in the rivet-receiving position;

FIG. 8 is a side elevation view of a delivery tube and gripping apparatus according to the invention showing the gripping apparatus moving towards the rivet locating position;

FIG. 9 is a sectional view taken along line 9—9 in FIG. 7;

FIG. 10 is a side elevation view of the gripping apparatus according to the invention showing the apparatus in a rivet locating position;

FIG. 11 is a front elevation view of a pair of fingers according to the invention;

FIG. 12 is a side elevation view of the pair of fingers shown in FIG. 11;

FIG. 13 is an enlarged view taken along line 13—13 in FIG. 11;

FIG. 14 is an enlarged sectional view taken along line 14—14 in FIG. 11;

FIG. 15 is a side elevation view of the delivery tube and fingers in accordance with a second embodiment of the invention;

FIG. 16 is a view taken along line 16—16 in FIG. 15;

FIG. 17 is a sectional view taken along line 17—17 in FIG. 16; and

FIG. 18 is a side view partially broken away of the discharge end of a rivet delivery tube according to the invention.

DESCRIPTION OF THE PREFERRED EMBODIMENT

Figure 1:
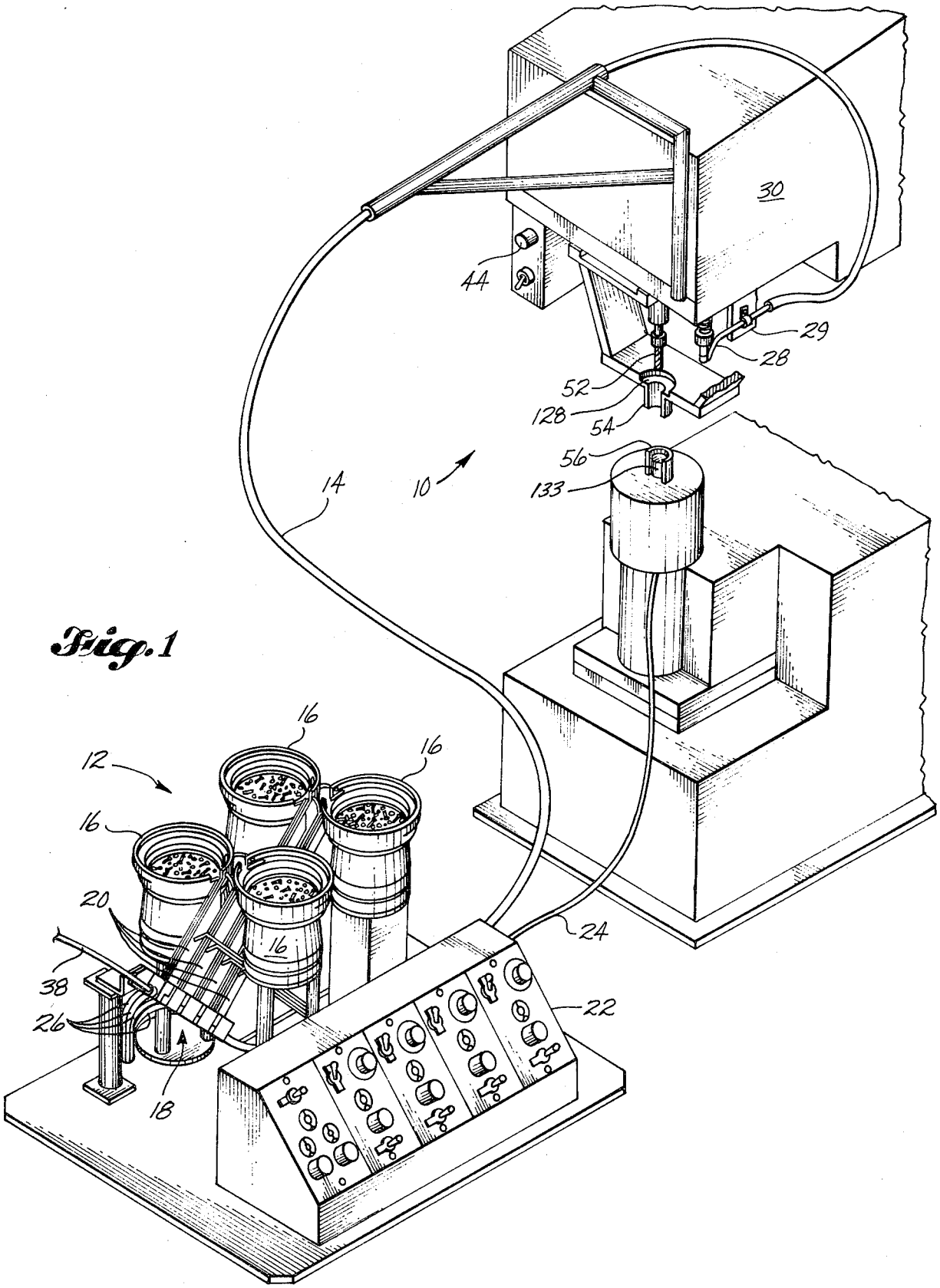
FIG. 1 is a pictorial view of a riveting machine utilizing rivet delivering and locating apparatus according to the invention.

As shown in FIG. 1, a riveting machine 10 is connected to a supply module 12 by a rivet feeding conduit 14. The supply module, as shown, includes four containers 16 which may each contain a quantity of rivets, with the size of rivets in each container being different from the size of rivets in the other containers. A rivet dispensing apparatus 18 receives orientated rivets from each container 16 and dispenses rivets individually through conduit 14 in an orientated manner to the riveting machine.

Means, not shown, may be provided for vibrating the containers 16 in order that rivets will automatically be fed from each container along an associated track 20 to a gating mechanism of the dispensing apparatus. A control console 22 contains coontrols which may be manipulated by an operator to turn the module on and off and to affect the feed rate of the containers 16. Providing orientated rivets automatically from a container to a dispensing apparatus in this manner is well known in the art, and a dispensing apparatus such as the one shown generally in FIG. 1 is described in detail in the co-pending United States patent application of Brian Trethewy, Ser. No. 864,059, filed Dec. 23, 1977, which application is owned by the same assignee as the instant application. Application Ser. No. 864,059 is hereby incorporated herein by reference.

A sensing means may be provided on the riveting machine 10 for sensing the aggregate thickness of the workpieces to be riveted, and the appropriate rivet size may be determined by controls within console 22 in response to signals received through a cable 24 from the sensing means. These controls then generate a triggering signal which causes the appropriate gate of the gating mechanism to be actuated by an associated air cylinder through one of a plurality of lines 26. The details of the sensing means and the manner of triggering the dispensing apparatus 18 are not essential to the present invention, but it is to be noted that the patent to A. E. Filangeri et al, earlier referred to herein, does disclose, in detail, a riveting machine including a thickness sensing and rivet selecting system.

The rivet feeding conduit 14 connects to a delivery tube 28 which is fixed by a bracket 29 to a rigid portion of the frame 30 of the riveting machine 10. The delivery tube 28 receives a rivet from conduit 14 and discharges the rivet from a discharge end 32 of the tube. Unlike conduit 14, the delivery tube 28 is a rigid conduit made of steel or the like; and the position of discharge end 32 is therefore fixed with respect to the frame of machine 10. The passageway defined by conduit 14 and tube 28 is generally circular in cross section and only slightly larger in diameter than the rivets passing therethrough. For that reason a rivet 34, propelled shank portion 36 first through the passageway by compressed air from a line 38, maintains the same orientation from the time it enters conduit 14 until it leaves delivery tube 28 at discharge end 32 thereof. The discharge end 32 of the delivery tube is curved or bent as best seen in FIGS. 8 and 9, and this configuration of the delivery tube insures a precise orientation of each rivet at discharge end 32 with the shank portion 36 contacting the radially outermost wall portion of the delivery tube passageway adjacent the curve, as shown in FIG. 18. This precise orientation is the result of the combined effect of air pressure and centrifugal forces acting against the rivet when the rivet is propelled along the bent portion of the delivery tube.

Figure 3:
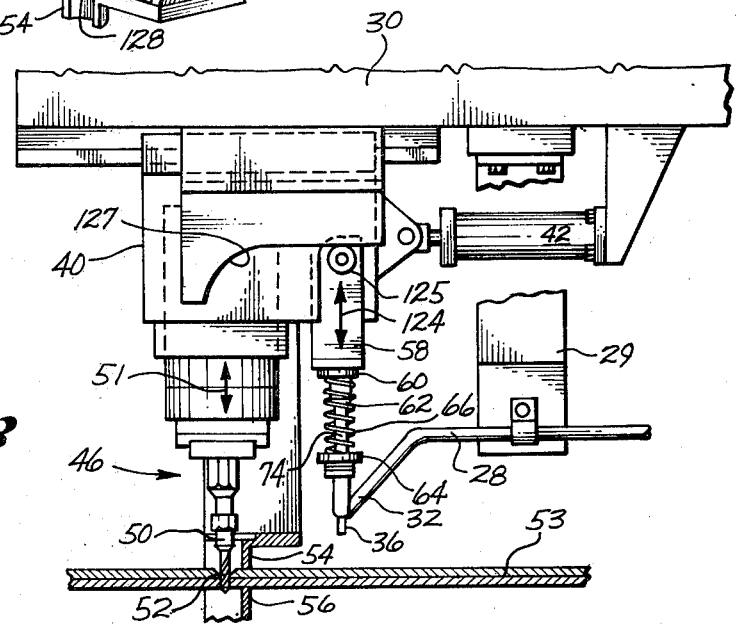
FIG. 3 is a side elevation view of the apparatus shown in FIG. 2 with the riveting machine performing a drilling operation on a workpiece.
Figure 4:
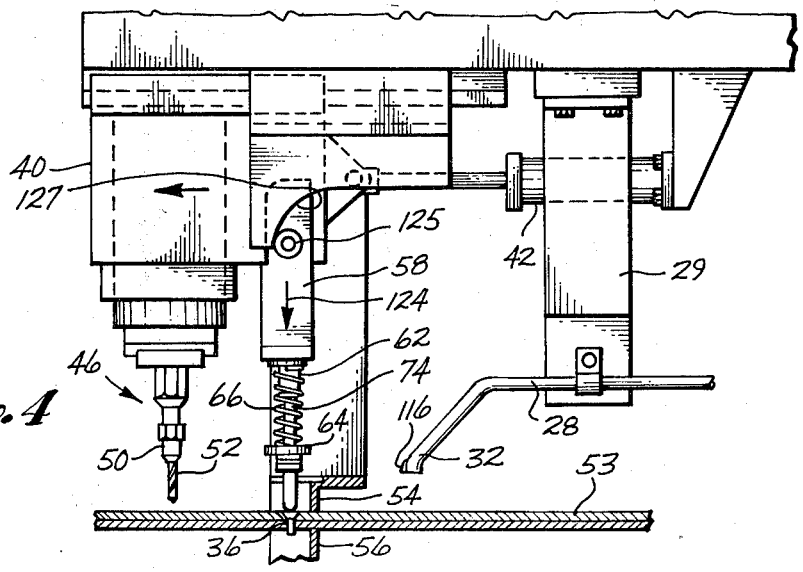
FIG. 4 is a side elevation view similar to FIG. 3, but showing the riveting machine with rivet gripping apparatus in a rivet locating position.

The riveting machine 10 includes a selectively movable carriage 40 mounted on the frame 30 of the machine for movement between first and second positions shown in FIGS. 3 and 4 respectively. Movement of the carriage on suitable bearings between the first and second positions is accomplished by a pneumatically-operated piston 42, and this movement may be directly controlled by the operator or may be automatically controlled by the controls within console 22 once the operator has initiated a riveting machine cycle by depressing a button 44 on the machine.

Mounted on the carriage 40 are a drilling apparatus 46 and a rivet gripping apparatus 48. The drilling apparatus 46 includes a chuck 50 which holds a drill bit 52, and with the carriage 40 in its first position the chuck 50 is downwardly movable as indicated by the arrow 51 in FIG. 3 to perform a drilling operation on one or more workpieces 53 clamped between upper and lower jaws 54 and 56 respectively of the machine 10.

The rivet gripping apparatus 48, as shown in FIG. 6, includes a mounting member 58 having a collar 60 fixed thereto. An anvil 62 is also fixed to member 58 and extends through a second collar member 64 which is vertically movable with respect to the anvil. A spring 66 contacts both collar members 60 and 64 to bias them apart in the vertical or longitudinal direction generally along the axis of the anvil. The lower face of the collar 64 defines downwardly-facing surfaces 68 and shoulders 70, and a pin 72 extends through a shank portion 74 of the anvil such that the opposite ends of pin 72 extend radially outwardly from shank portion 74 on opposite sides thereof.

A pair of identical holding blocks 76 include upper surfaces 78 and side surface 80 for contacting surfaces 68 and shoulders 70 respectively of the collar 64. The blocks 76 also include groove portions 82 for receiving a spring 84 which encompasses the blocks and biases them together.

A pair of fingers 86 and 88 are mounted between blocks 76 and the lower shank portion of the anvil. These fingers 86 and 88 each include an upper flange portion 90 extending about the entire circumference of the fingers, and adjacent end surface portions 92 and 94 of the flange portions 90 contact each other as shown in FIG. 7 on opposite sides of the anvil. Of course, in FIG. 7 contact between these surfaces on only one side of the anvil is seen since the opposite side of the anvil is not visible. The upper outside portions of the fingers below flanges 90 define generally cylindrical surfaces, and blocks 76 define inside surfaces substantially corresponding to these cylindrical surfaces when the blocks and fingers are assembled as in FIG. 7. The blocks 76 also include slots or recesses corresponding to flanges 90, and flanges 90 are received by these recesses in the blocks when the fingers and blocks are assembled. The upper portions of fingers 86 and 88, which define the flanges 90 and the cylindrical surfaces, are identical to each other. Each finger also includes a tab or shoulder 96 extending above flange 90 which is received in a corresponding groove 98 in its corresponding block 76, and the function of these tabs 96 and grooves 98 is to prevent the fingers from turning with respect to the blocks. The flanges 90 and their corresponding recesses prevent the fingers from moving longitudinally with respect to each other.

Longitudinal recesses 100 are defined in the side boundary portions of the fingers 86 and 88 so that with the fingers assembled between the anvil 62 and the blocks 76 as in FIG. 7 a longitudinally-extending opening or slot 102 is defined between the fingers below the contacting end surface portions 92 and 94 on opposite sides of the assembly comprising the two fingers. Each of the two slots 102 thus provided receives one of the end portions of pin 72 extending from the anvil, and the dimensions of the slots 102 and the pin 72 are such that the end portions of the pin are each slidable along their corresponding slot. In the position shown in FIGS. 7 and 8, the separating force exerted by spring 66 against the two collars 60 and 64 causes the end portions of pin 72 to contact the flange portions 90, and the pin 72 to contact the flange portions 90, and the pin 72 in this way acts as a stop to limit downward movement of the fingers in response to the force from the spring 66. The pin 72 also serves to prevent rotation of the fingers with respect to the anvil.

It will be seen from FIG. 7 that with the fingers 86 and 88, the blocks 76, and the spring 84 assembled on the anvil 62 the side portions of the block do not contact each other and, in fact, define a space 104 between the blocks which is generally aligned with slots 102 defined between the fingers. The space 104 ensures that there will be no interference between the blocks and the pin 72 when the fingers move vertically with respect to the anvil and that the force from spring 84 which biases the blocks together about the anvil will be effective to bias the fingers together. Thus the spring 84 is effective to hold the top portions of fingers 86 and 88 tightly together, but the lower or distal end portions of the fingers may be moved apart against the bias of spring 84. When the distal ends of the fingers are moved apart in this way the blocks pivot slightly, with respect to collar 64, on edges 106 defined between the upper and side surfaces 78 and 80 respectively of the blocks 76; and, as a result, the upper portions of the blocks tend to move together. The space 104 between the blocks therefore also allows ample freedom from the blocks to pivot in this manner. It should be noted also that when the blocks pivot as described the fingers pivot with respect to each other on an axis extending between the fingers along the top of flange portion 90.

The fingers 86 and 88 are shown in detail in FIGS. 11–14. It has already been noted that the upper portions of the two fingers are identical, and the lower or rivet gripping portions of the two fingers are likewise identical to each other. The rivet gripping portion of each finger includes a generally radially-inwardly extending surface 108 which may, as shown, correspond generally to the configuration of the undersurface 110 of the head portion 112 of a rivet which is aligned longitudinally with the fingers; and also includes a surface 114 having a generally semi-circular cross-section and extending parallel to the axis or length of the fingers. Actually, the surface 114 has a cross section with an arc slightly less than 180 degrees to facilitate a gripping of the shank portion of a rivet by these opposed rivet gripping surfaces 114 of the fingers. The primary functions of the surfaces 108 is to catch and support the head of a rivet when the rivet is first received by the fingers and thereafter to stabilize the position of the rivet and prevent its canting with respect to the longitudinal axis fingers.

As best seen in FIGS. 7 and 8, the delivery tube 28 includes a camming means shown as a protrusion 116 mounted on the outside of the discharge end of the tube. The function of the camming means is to first move the distal ends of the fingers apart and then to hold them apart so that a rivet can be received between the gripping surfaces 114 from the delivery tube 28.

As seen in FIGS. 11–14,, the finger 86 defines an opening 118 through its sidewall, whereas the finger 88 does not have such an opening. The finger 88 instead defines a smooth cylindrical surface 120 opposite to and facing the opening 118 in finger 86. As shown in FIGS. 6 and 9, the opening 118 is large enough to admit the discharge end of delivery tube 28 freely therethrough.

The rivet gripping apparatus 48 is shown in FIG. 7 in a rivet receiving position which may correspond to the first position of the carriage 40. In this position the discharge end 32 of the delivery tube 28 extends through the opening 118, and the protrusion 116 contacts the surface 120 to hold the finger 88 with its distal end spaced from the distal end of finger 86 thereby defining a rivet receiving mode of the gripping apparatus with the rivet gripping surfaces 114 spaced apart as shown in FIG. 9. In this spaced-apart position the surfaces 114 define a generally circular opening, and in the rivet receiving mode the discharge opening at the discharge end of delivery tube 28 is substantially aligned with, that is, above and substantially concentric with the circular opening defined by surfaces 114.

FIG. 8 shows the gripping apparatus 48 in a gripping mode with the distal ends of the fingers biased together by spring 84 and the opposed gripping surfaces pressing against the shank portion of a rivet. As shown in FIG. 8, the apparatus 48 is moving in the direction indicated by arrow 122 towards the position shown in FIGS. 4 and 10. The position of the gripping apparatus 48 shown in FIGS. 4 and 10 may correspond to the second or rivet locating position of the carriage 40.

It will be understood that as the apparatus 48 reaches the rivet locating position the member 58 and anvil 62 are moved downwardly in the direction indicated by arrows 124 because bearings 125 fixed to opposite sides of mounting member 58 are forced downwardly along tracks 127 fixed to frame 30 as the carriage moves forward toward its second position. The collar 64, the blocks 76, and the fingers 86 and 88 all move downwardly with the anvil until bottom surfaces 126 of the blocks contact a surface 128 on the frame of the machine above upper jaw 54. At this time the shank of the rivet held between the fingers extends into the hole previously drilled in the workpieces, as shown in FIG. 4. As the anvil continues its downward movement, it will contact the top of the rivet and force the head of the rivet between the surfaces 114 of the fingers. The distal ends of the fingers separate in the direction of arrows 131 to accommodate the movement of the rivet until the anvil has itself moved between the surfaces 114 and is holding the rivet firmly against the upper workpiece, as shown in FIG. 10. A ram shown at 133 in FIG. 1 then comes up from below and performs a heading operation on the shank of the rivet in a conventional and well known manner.

An alternate embodiment of the rivet gripping fingers is shown in FIGS. 15–17. According to the alternate embodiment of the invention the fingers are rotated about the axis of the anvil 90 degrees so that the slots between the fingers face a discharge end **32*a* of a delivery tube 28*a*. The boundary portions 130 and 132 of the modified fingers 86*a* and 88*a* respectively define a slot 134 which may be similar to the slots 102 of the fingers 86 and 88 shown in FIGS. 11 and 12. However, the boundary portions 136 and 138 of the modified fingers define a slot 140 which includes a wider lower slot portion 142. The lower slot portion 142 is large enough to freely admit the discharge end 32*a*, and the discharge end includes a camming means shown as a protrusion 116*a* which is aligned with the slot 134. When the rivet gripping apparatus 48*a* moves into a rivet receiving position as shown in FIG. 15 the protrusion moves into the slot 134, and camming surfaces 142 on opposite sides of the protrusion 116*a* contact surface portions of the boundary portions 130 and 132. Due to the tapered configuration of protrusion 116*a* and the cam surfaces 142 the distal ends of the fingers 86*a* and 88*a* are moved apart slightly in response to this movement to the position shown in FIG. 17 to receive a rivet from the delivery tube 28*a*. As in the preferred embodiment hereinbefore described, the fingers 86*a* and 88*a* are spring biased to a rivet gripping position upon movement of the apparatus 48*a*** away from the rivet receiving position.

Referring once again to the preferred embodiment first described herein, a riveting machine in accordance with the invention operates as follows. Workpieces 53 are placed between the jaws 54 and 56 of the riveting machine 10 and a riveting machine cycle is initiated by operating button 44. The lower jaw 56 then moves upwardly until the workpieces are clamped tightly between the jaws. The drilling apparatus 46 then moves downwardly and, as best seen in FIG. 3, drills a hole in the workpiece.

While the drilling operation is taking place, the sensing means determines the aggregate thickness of the workpieces based on the distance between the jaws, and with this information the controls determine the correct rivet size and provide a triggering signal to the dispensing apparatus 18. The dispensing apparatus responds to this signal by introducing an individual rivet of the proper size, shank portion first, into the conduit 14; and the rivet is propelled by compressed air through the conduit and into the delivery tube 28 as best seen in FIG. 7.

Figure 2:
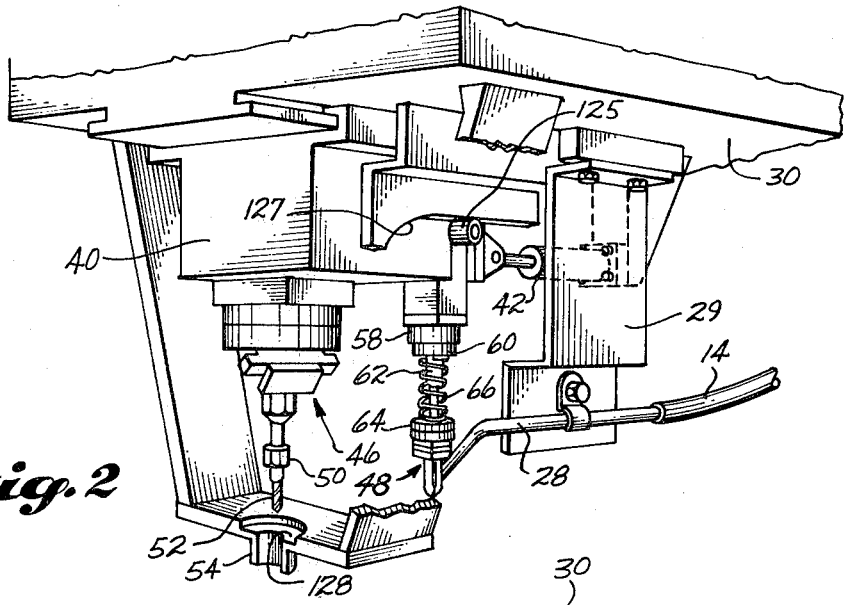
FIG. 2 is an enlarged pictorial view of one portion of the riveting machine shown in FIG. 1.

Because the rivet gripping apparatus is in the rivet receiving position, shown in FIGS. 2 and 3 and with greater detail in FIGS. 6 and 7, the lower or distal end of finger 88 is held by protrusion 116 away from the distal end of finger 86; and the discharge opening of the delivery tube is substantially aligned with the opening formed between the gripping surfaces of the fingers. The rivet passes, shank first, through the discharge tube and, being precisely orientated by the bend in the delivery tube adjacent the discharge end, passes from the discharge tube with the shank portion moving freely between the gripping surfaces until the head of the rivet is caught by the inwardly extending surfaces 108 of the fingers. The rivet is held by surfaces 108 in this manner until the drilling operation is complete.

Upon completion of the drilling operation, the drilling apparatus retracts, and the carriage moves to the locating position shown in FIG. 4. As soon as the carriage begins to move, contact between finger 88 and protrusion 116 is eliminated, and the spring 84 acts through blocks 76 to cause gripping surfaces 114 of the fingers to press tightly against the shank of the rivet holding it firmly in position with respect to the fingers as the rivet gripping apparatus moves.

When the gripping apparatus reaches the locating position as shown in FIG. 4 the anvil moves downwardly as previously described, and the rivet is located for a heading operation as shown in FIG. 10. Upon completion of the heading operation the carriage moves back to its rivet receiving position, and the discharge end portion of the delivery tube moves through opening 118 in finger 86. When protrusion 116 contacts the surface 120 of finger 88 the remaining movement of the carriage back to its first position causes the lower portions of the fingers to again separate, and the gripping apparatus 48 is ready to receive another rivet. The machine is therefore ready to begin another cycle, and these cycles may be repeated as rapidly as may be desired.

The invention herein disclosed therefore provides a very rapid feeding of individual rivets to the gripping apparatus while utilizing a minimum number of parts. Furthermore, the number of steps required for delivery and location of each rivet is minimized, and a precise orientation of the rivet is maintained throughout the delivery and location operation.

The foregoing description of my invention discloses a preferred embodiment thereof, and various changes and omissions in form and detail may be made within the scope of the invention which is defined and limited only by the following claims.

What is claimed is:

1. In a riveting apparatus including supply means for providing orientated rivets each having both a head portion and a shank portion and means for performing a heading operation on said rivets; improved means for delivering and locating said rivets for said heading operation, said improved means comprising:

a delivery tube including a discharge end and defining a conduit through which rivets received from said supply means are propelled to said discharge end;

gripping means for receiving said rivets from said discharge end and gripping said rivets, said gripping means including a plurality of gripping surfaces and operable to a receiving mode with said surfaces spaced apart a distance sufficient to admit the shank portion but not the head portion of an individual rivet therebetween and a gripping mode with said surfaces biased into gripping contact against said shank portion;

operating means for operating said gripping means to said receiving mode prior to said individual rivet leaving said discharge end and to said gripping mode after said individual rivet has been received by said gripping means; and means for positioning said gripping means for locating said individual rivet for said heading operation.

2. In a riveting apparatus as claimed in claim 1 wherein said conduit includes a bent portion adjacent said discharge end to assure a proper orientation of said individual rivet when received by said gripping means.

3. In a riveting apparatus as claimed in claim 1 wherein said means for operating said gripping means comprises cam means carried by said delivery tube for camming said surfaces apart and spring means for biasing said surfaces together.

4. In a riveting apparatus as claimed in claim 3 wherein said cam means comprises a cam member fixed to said delivery tube adjacent said discharge end.

5. In a riveting apparatus as claimed in claim 1 wherein said gripping means comprises a plurality of fingers each defining a gripping portion at a distal end portion thereof, and a spring encompassing said plurality of fingers and biasing them together, at least one of said fingers movable against the bias of said spring in response to said operating means.

6. Rivet delivery and locating apparatus for a riveting machine utilizing rivets each including a shank portion and a head portion, said rivet delivery and locating apparatus comprising:

a delivery tube including a discharge end and defining a conduit through which individual rivets are propelled to said discharge end;

rivet gripping apparatus including a pair of fingers separable at a distal end thereof for receiving an individual rivet from said discharge end, the distal ends of said fingers defining opposed gripping surfaces for gripping the shank portion of said individual rivet, said rivet gripping apparatus further including means for biasing said gripping surfaces together;

carriage means for moving said gripping apparatus between a rivet receiving position and a rivet locating position; and camming means for acting on at least one of said pair of fingers whenever said gripping apparatus is in said rivet receiving position to hold said gripping surfaces apart a distance sufficient to admit the shank portion but not the head portion of said individual rivet therebetween.

7. Rivet delivery and locating apparatus as claimed in claim 6 wherein said discharge end is substantially centered over a space defined between said gripping surfaces while said rivet gripping apparatus is in said rivet receiving position.

8. Rivet delivery and locating apparatus as claimed in claim 6 wherein said conduit includes a bent portion adjacent said discharge end to assure a proper orientation of said rivet when received by said rivet gripping apparatus.

9. Rivet delivery and locating apparatus as claimed in claim 6 wherein said means for biasing said gripping surfaces together comprises a spring encompassing said fingers.

10. Rivet delivery and locating apparatus as claimed in claim 6 wherein said camming means comprises a protrusion on said discharge end of said delivery tube.

11. Rivet delivery and locating apparatus as claimed in claim 10 wherein said delivery tube is mounted in a fixed position and said surfaces grip the shank portion of said individual rivet whenever said gripping apparatus has moved away from said rivet receiving position toward said rivet locating position.

12. Rivet delivery and locating apparatus as claimed in claim 10 wherein one finger of said pair defines an opening through which said discharge end of said tube and said protrusion extend with said gripping apparatus in said rivet receiving position and wherein the other finger of said pair includes a surface against which said protrusion acts with said gripping apparatus in said rivet receiving position to hold said gripping surfaces apart.

13. Rivet delivery and locating apparatus as claimed in claim 10 wherein each finger of said pair includes a surface portion contactable by said protrusion, said protrusion moving said gripping surfaces apart when said gripping apparatus moves into said rivet receiving position.

14. Rivet delivery and locating apparatus as claimed in claim 10 wherein the fingers of said pair define adjacent first boundary portions spaced apart to allow said discharge end and said protrusion to pass freely therebetween, and also define adjacent second boundary portions against which said protrusion acts to hold said gripping surfaces apart while said gripping apparatus is in said rivet receiving position.

15. In a riveting machine including receiving means for receiving orientated rivets each having a head portion and a shank portion, a rigid frame, a carriage movable with respect to said frame, means for selectively moving said carriage, and means for performing a heading operation on a properly located rivet; the improvement comprising:

a rivet gripping apparatus mounted on said carriage for movement therewith between a rivet receiving position and a rivet locating position, said rivet gripping apparatus including a pair of fingers defining opposed gripping surfaces at a distal end thereof and biasing means for biasing said gripping surfaces together; and a delivery tube fixed to said frame and defining a passageway for delivering individual rivets from said receiving means to an end portion of said delivery tube defining a discharge opening, said delivery tube including a protrusion extending from said end portion, said protrusion contacting at least one of said fingers while said gripping apparatus is in said rivet receiving position to hold said gripping surfaces apart against the force of said biasing means and thereby form an opening between said gripping surfaces of a size to receive the shank portion but not the head portion of an individual rivet, said opening substantially aligned with said discharge opening of said delivery tube, said gripping surfaces gripping said shank of said individual rivet upon said carriage leaving said rivet receiving position and continuing to grip said shank portion until said carriage reaches said rivet locating position for properly locating said individual rivet for said heading operation.

16. In a riveting machine as claimed in claim 15 wherein said opening between said gripping surfaces is a generally circular opening.

17. In a riveting machine as claimed in claim 15 wherein said fingers further define surfaces for supporting said individual rivet through contact with said head portion of said individual rivet with said rivet gripping apparatus in said rivet receiving position.

18. In a riveting machine as claimed in claim 15 wherein said gripping surfaces extend in a longitudinal direction with respect to said fingers and said fingers further define surfaces extending generally inwardly from said gripping surfaces, said inwardly-extending surfaces contacting said head portion of said individual rivet for supporting said individual rivet between said fingers while said protrusion holds said gripping surfaces apart and for preventing the canting of said individual rivet while said gripping surfaces are gripping said shank of said individual rivet.

19. In a riveting machine as claimed in claim 15 wherein said delivery tube includes a curved portion adjacent said discharge opening for assuring a proper orientation of said individual rivet for delivery of said shank portion of said individual rivet into said opening between said gripping surfaces of said fingers.

20. In a riveting machine as claimed in claim 15 wherein one finger of said pair defines an opening through which said end portion of said delivery tube and said protrusion extend with said rivet gripping apparatus in said rivet receiving position and wherein the other finger of said pair includes a surface against which said protrusion acts with said rivet gripping apparatus in said rivet receiving position to hold said gripping surfaces apart.

21. In a riveting machine as claimed in claim 15 wherein the fingers of said pair define adjacent first boundary portions spaced apart to allow said end portion of said delivery tube and said protrusion to pass freely therebetween and also define spaced second boundary portions, said protrusion including cam surfaces for contacting said second boundary portions as said protrusion moves therebetween for holding said gripping surfaces apart.

* * * * *